US006699311B2

(12) United States Patent
Smith et al.

(10) Patent No.: US 6,699,311 B2
(45) Date of Patent: Mar. 2, 2004

(54) HYDRAULIC QUICK DROP CIRCUIT

(75) Inventors: David P. Smith, Joliet, IL (US); Rudy V. Mills, Joliet, IL (US); Robert A. Aarestad, Washington, IL (US); Chad T. Brickner, Raleigh, NC (US)

(73) Assignee: Caterpillar Inc, Peoria, IL (US)

( * ) Notice: Subject to any disclaimer, the term of this patent is extended or adjusted under 35 U.S.C. 154(b) by 94 days.

(21) Appl. No.: 10/029,183

(22) Filed: Dec. 28, 2001

(65) Prior Publication Data

US 2003/0121410 A1 Jul. 3, 2003

(51) Int. Cl.[7] ..... F15B 13/04
(52) U.S. Cl. ..... 96/436; 91/451
(58) Field of Search ..... 91/436, 437, 438, 91/451, 31, 32

(56) References Cited

U.S. PATENT DOCUMENTS

| | | | | | |
|---|---|---|---|---|---|
| 3,568,707 A | * | 3/1971 | Shore | 91/436 |
| 3,604,313 A | | 9/1971 | Fruehauf | |
| 3,633,461 A | * | 1/1972 | Taki et al. | 91/436 |
| 3,727,519 A | * | 4/1973 | Hassel | 91/436 |
| 3,795,177 A | | 3/1974 | Cryder et al. | |
| 3,965,587 A | | 6/1976 | Johns, Jr. | |
| 4,437,385 A | | 3/1984 | Kramer et al. | |
| 4,505,339 A | | 3/1985 | Kramer et al. | |
| 4,732,076 A | | 3/1988 | Ewald | |
| 5,014,734 A | | 5/1991 | Smith | |
| 5,226,348 A | | 7/1993 | Dezelan et al. | |
| 5,251,705 A | | 10/1993 | Waggoner et al. | |
| 5,351,601 A | | 10/1994 | Zeuner et al. | |
| 5,370,038 A | * | 12/1994 | Poppe et al. | 91/436 |
| 5,907,991 A | | 6/1999 | Ramamoorthy et al. | |

* cited by examiner

*Primary Examiner*—Edward K. Look
*Assistant Examiner*—Igor Kershteyn
(74) *Attorney, Agent, or Firm*—Finnegan, Henderson, Farabow, Garrett & Dunner; Steve M Hanley

(57) ABSTRACT

A fluid circuit for raising and lowering an implement including a quick drop valve member movable between at least a first position and a second position, the first position corresponding to a non-quick drop hydraulic fluid flow path of the fluid circuit and the second position corresponding to a quick drop hydraulic fluid flow path of the fluid circuit, the quick drop valve member being movable between at least the first and second positions based on pressures in the fluid circuit produced by hydraulic fluid. The fluid circuit further including a control system configured to selectively apply a biasing force against the quick drop valve member biasing the quick drop valve in the first position, the control system providing the biasing force independent of pressures in the fluid circuit produced by the hydraulic fluid.

20 Claims, 2 Drawing Sheets

HYDRAULIC QUICK DROP CIRCUIT

TECHNICAL FIELD

This invention relates generally to a hydraulic circuit for controlling the elevational position of a bulldozer blade or the like, and more particularly, to the incorporation and control of a quick drop valve for improving the efficiency of the circuit.

BACKGROUND

Quick drop valves are commonly used in hydraulic control circuits for bulldozer blades or the like in which the blade is allowed to free-fall to ground level under the force of gravity. Some of the fluid expelled from the hydraulic cylinders which control blade elevation is diverted by the quick drop valves to the expanding ends of the hydraulic cylinders to supplement the pump flow thereto. Without any type of quick drop valve, the expanding ends of the hydraulic cylinders may cavitate quite significantly. Since the cavitated ends of the cylinders have to be filled with fluid from the pump after the blade comes to rest on the ground, a considerable time lag occurs before sufficient downward force can be applied to the blade for penetrating the ground. The use of quick drop valves minimizes the cavitation and thus reduces the time lag.

The duration of the time lag depends upon the efficiency of the quick drop valve, which is determined by the amount of expelled fluid that the quick drop valve diverts back to the expanding side of the cylinders. That amount is dependent upon how quickly the quick drop valve moves to the quick drop position in a free-fall situation and the percentage of the expelled fluid that the quick drop valve diverts back to the expanding ends once it is in the quick drop position.

An example of a quick drop circuit is provided by U.S. Pat. No. 5,014,734 to Smith which provides a hydraulic circuit having a quick drop valve that is actuated based on the pressures created by the hydraulic fluid flow through the circuit. Actuation of the quick drop valve occurs somewhere within a range of movement of an operator controlled lever during a controlled lowering operation which may be non-intuitive to the operator. Further, the operation controlled lever lacks a position for a floating blade operation to allow the blade to freely move vertically when traveling along the surface of the ground.

The present invention is directed to overcoming one or more of the problems as set forth above.

SUMMARY OF THE INVENTION

In accordance with one aspect of the invention, a fluid circuit for raising and lowering an implement includes a quick drop valve member movable between at least a first position and a second position, the first position corresponding to a non-quick drop hydraulic fluid flow path of the fluid circuit and the second position corresponding to a quick drop hydraulic fluid flow path of the fluid circuit, the quick drop valve member being movable between at least the first and second positions based on pressures in the fluid circuit produced by hydraulic fluid. The fluid circuit further including a control system configured to selectively apply a biasing force against the quick drop valve member biasing the quick drop valve in the first position, the control system providing the biasing force independent of pressures in the fluid circuit produced by the hydraulic fluid.

According to another aspect of the present invention, a fluid circuit for raising and lowering an implement includes a hydraulic fluid pump, at least one hydraulic cylinder selectively hydraulically coupled to the hydraulic fluid pump, the at least one hydraulic cylinder including a lift side and a drop side and being coupled to a working implement, at least one control valve located between the hydraulic fluid pump and the at least one hydraulic cylinder, a hydraulic-fluid-actuated quick drop valve located between the control valve and the at least one hydraulic cylinder, the quick drop valve including a quick drop valve member movable between a first valve member position blocking hydraulic fluid communication between the lift side and drop side of the at least one hydraulic cylinder, and a second valve member position allowing hydraulic fluid communication between the lift side and the drop side of the at least one hydraulic cylinder, and a fluid lock selectively fluidly biasing the quick drop valve member in the first position.

According to another aspect of the present invention, a fluid circuit for raising and lowering an implement includes a hydraulic fluid pump, a plurality of hydraulic cylinders selectively hydraulically coupled to the hydraulic fluid pump, the plurality of hydraulic cylinders each including a lift side and a drop side and being coupled to a working implement, at least one control valve located between the hydraulic fluid pump and the plurality of hydraulic cylinders, the control valve having four positions, the four positions corresponding to a rising implement operation of the fluid circuit, a controlled lowering of implement operation of the fluid circuit, a holding of implement operation of the fluid circuit and a floating of implement operation of the fluid circuit, a quick drop valve located between the control valve and the plurality of hydraulic cylinders, the quick drop valve including a quick drop valve member movable by hydraulic fluid within the fluid circuit between a first valve member position blocking hydraulic fluid communication between the lift sides and drop sides of the plurality of hydraulic cylinders and a second valve member position allowing hydraulic fluid communication between the lift sides and the drop sides of the plurality of hydraulic cylinders, and a solenoid valve having a flow-through position allowing pressurized pilot fluid to flow to the quick drop valve to bias the quick drop valve member in the first position, and a blocked position disconnecting the pressurized pilot fluid flow to the quick drop valve member, the solenoid valve being actuated to its blocked position by an electric switch activated by moving an operator controlled lever to a triggering position.

According to yet another aspect of the present invention, a method for controlling movement of an implement includes positioning an operator controlled lever to at least a first position corresponding to a raising implement operation and the application of a biasing force against a quick drop valve member of a quick drop valve, positioning the operator controlled lever to at least a second position corresponding to a holding implement operation and the application of the biasing force against the quick drop valve member, positioning the operator controlled lever to at least a third position corresponding to a controlled lowering implement operation and the application of the biasing force against the quick drop valve member, and positioning the operator controlled lever to at least a fourth position corresponding to a releasing of said biasing force against the quick drop valve member to allow the quick drop valve member to move between a quick drop position and a non-quick drop position.

It is to be understood that both the foregoing general description and the following detailed description are exemplary and explanatory only and are not restrictive of the invention, as claimed.

The accompanying drawings, which are incorporated in and constitute a part of this specification, illustrate an exemplary embodiment of the invention and together with the description, serve to explain the principles of the invention.

DETAILED DESCRIPTION

Reference will now be made in detail to the exemplary embodiments of the invention, an example of which is illustrated in the accompanying drawings. Wherever possible, the same reference numbers will be used throughout the drawings to refer to the same or like parts.

Figure 1A:
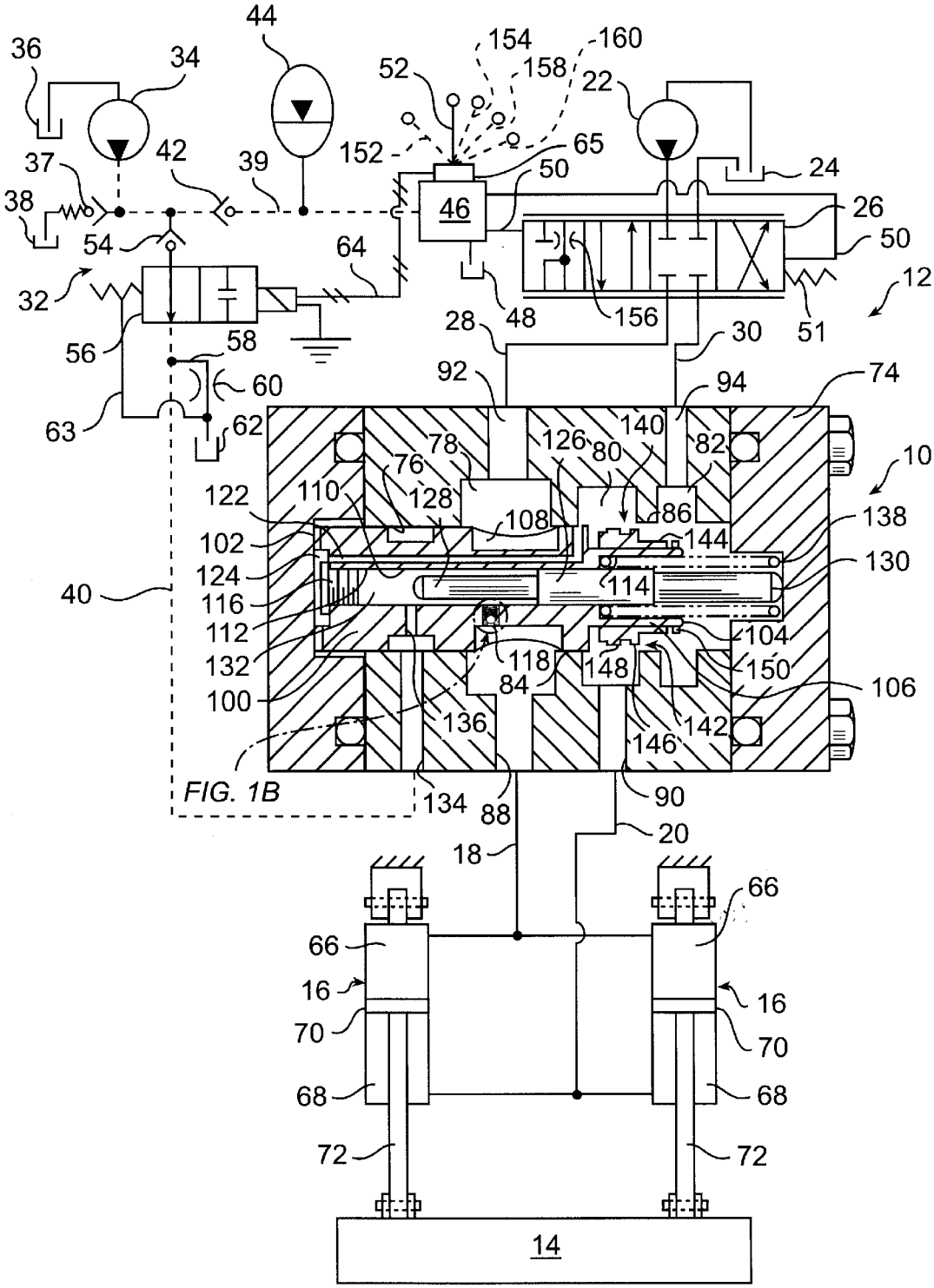
FIG. 1A is a diagrammatic and sectional view of a hydraulic control circuit according to an exemplary embodiment of the present invention.

Referring to FIG. 1A, a quick drop valve 10 is shown incorporated within a hydraulic circuit 12 for controlling the elevation of a load, for example, an implement such as a bulldozer blade 14 of an earth moving machine. Hydraulic circuit 12 may include a pair of double acting hydraulic cylinders 16, a pair of cylinder conduits 18, 20 connecting quick drop valve 10 to opposite ends of hydraulic cylinders 16, a pump 22 and a tank 24 connected to a directional control valve 26, and a pair of valve conduits 28, 30 connecting directional control valve 26 to quick drop valve 10.

Control valve 26 may be a four (4) position four (4) way valve of any conventional design. As will be described further below, control valve 26 may include a position for each of a raising blade operation, a holding blade operation, a controlled lowering blade operation, and a floating blade operation. Alternatively, control valve 26 may be formed of any other configuration, including a single valve (as shown) or multiple valves, and control valve 26 could be pilot actuated (as shown), electrically actuated, or mechanically actuated.

An auxiliary control system for quick drop valve 10 may include a pilot circuit, generally indicated at 32. Pilot circuit 32 may include a pilot pump source 34, a tank 36, a pressure relief valve 37 connected to a tank 38, a first pilot fluid line 39 and a second pilot fluid line 40. First pilot fluid line 39 extends from pilot pump source 34 to directional control valve 26 and may include a check valve 42, an accumulator 44 and a pilot valve 46. Pilot valve 46 may include a tank 48 and pilot fluid lines 50 to each side of directional control valve 26, and may be controlled by a variable position, operator controlled lever 52.

Second pilot fluid line 40 may be coupled between pilot pump source 34 and quick drop valve 10 and may include a check valve 54, a solenoid valve 56, and a drainage line 58 with a restriction 60 and a tank 62. Solenoid valve 56 may be a two (2) position two (2) way valve having a leakage line 63 connected to tank 62. Alternatively, solenoid valve 56 could be a two (2) position three (3) way valve, or any other conventional valve configuration. Solenoid valve 56 may be electrically coupled via electric line 64 to an electric switch 65. Switch 65 may be actuated or closed based on the position of operator controlled lever 52 to thereby provide selective actuation of solenoid valve 56.

Hydraulic cylinders 16 may be suitably connected to a work machine, not shown, in the usual manner with each hydraulic cylinder 16 having a head end or drop side 66 connected to cylinder conduit 18, a rod end or lift side 68 connected to cylinder conduit 20, a piston 70 slidably disposed therein, and a piston rod 72 connecting pistons 70 to blade 14. Blade 14 may be acted on by gravity such that the weight thereof establishes a generally downwardly dropping direction tending to extend hydraulic cylinders 16.

Quick drop valve 10 may include a multi-piece housing 74 having a bore 76 therein and a plurality of annuluses 78, 80, 82 in open communication with, and axially spaced along bore 76. Adjacent annuluses 78 and 80 may be separated by a control land 84 and adjacent annuluses 80 and 82 may be separated by another control land 86. Housing 74 may also have a pair of communicating with the annuluses 78 and 80 respectively and a pair of valve ports 92, 94 communicating with annuluses 78 and 82 respectively. Cylinder conduits 18 and 20 may be connected to cylinder ports 88 and 90, respectively, and valve conduits 28 and 30 may be connected to valve ports 92 and 94, respectively. Alternatively, valve port 92 may be omitted and valve conduit 28 connected directly to cylinder conduit 18. Another alternative would be to mount housing 74 directly to one of hydraulic cylinders 16 with the porting therein suitably changed.

A cylindrical valve member 100 may be slidably disposed in bore 76 and have opposite ends 102, 104 and a reduced diameter portion 106 adjacent end 104. A fluid control pocket 108 may be provided in valve member 100 intermediate ends 102, 104. An axially extending stepped bore 110 may be formed in valve member 100 and have opposite ends 112, 114. End 112 of stepped bore 110 may be sealingly closed with a threaded plug 116 and will hereinafter be referred to as the closed end while end 114 will be referred to as the open end. Valve member 100 may have a passageway 122 which continuously communicates the annulus 80 with an actuating chamber 124 at end 102 of valve member 100. Valve member 100 is shown in FIG. 1A in a blocking or first position, in which annulus 78 is blocked from communication with annulus 80. Valve member 100 may include a quick drop or second position at which annulus 80 is in communication with annulus 78 through fluid control pocket 108.

Figure 1B:
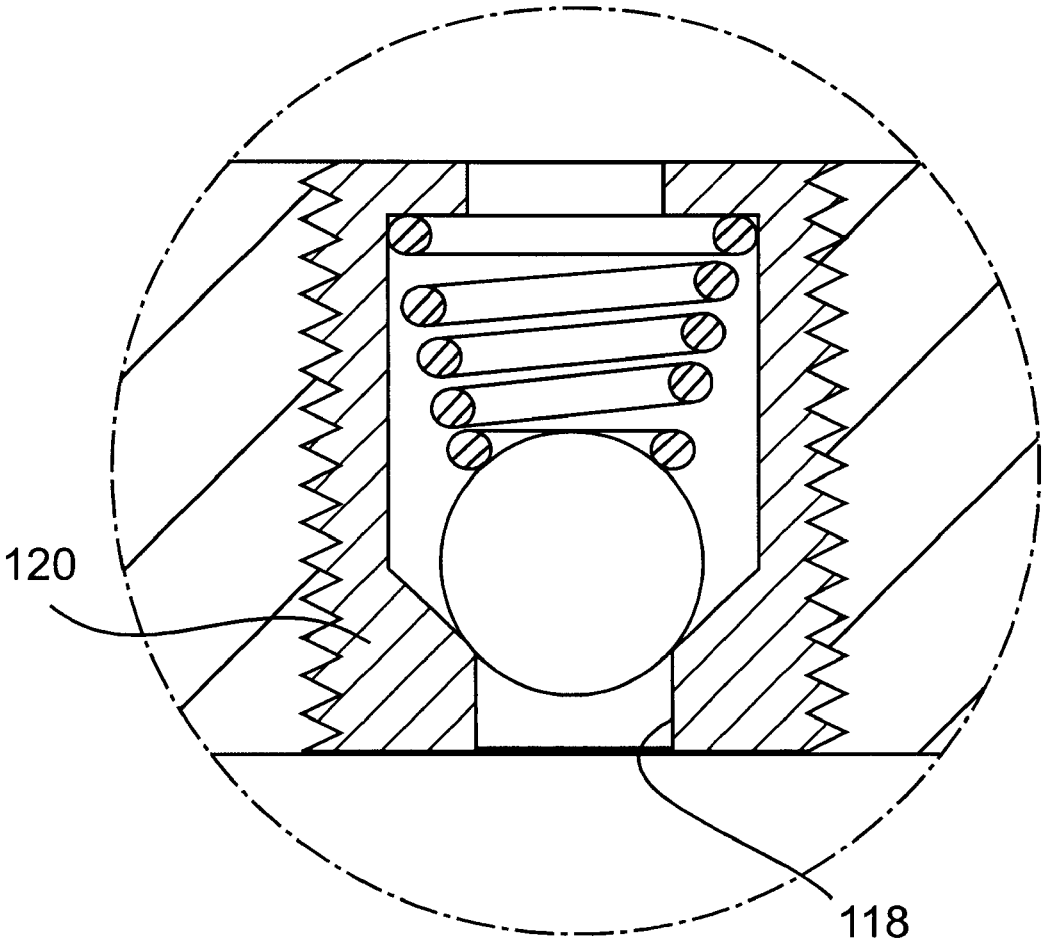
FIG. 1B is an enlarged view of the encircled portion of the quick drop valve of FIG. 1A.

An elongate bias piston 126 may be slidably disposed in bore 110 of valve member 100 and may have opposite reduced diameter end portions 128, 130. End portion 130 may project outwardly of open end 114 of valve member 100 and may normally be in contact with housing 74. End portion 128 of piston 126 may define an actuating chamber 132 at closed end 112 of bore 110. A radial passage 118 may communicate with actuating chamber 132 through a spring biased check valve 120 (FIG. 1B) arranged so as to only allow fluid flow into chamber 132 through passage 118. Second pilot fluid line 40 may be in communication with actuation chamber 132 by way of a further radial passage 134 formed in housing 74 and a radial passage 136 formed in valve member 100.

A coil compression spring 138 may circumscribe the portion of piston 126 extending beyond valve member 100 and may be disposed between valve member 100 and the housing 74 for resiliently biasing valve member 100 to the first leftmost position. Spring 138 and the force exerted on the valve member by pressurized fluid in actuating chamber 132 may each provide a biasing force for biasing valve member 100 to the first position.

A valve mechanism 140 may be provided for defining an annular orifice 142 between annuluses 80, 82. Annular orifice 142 may allow substantially unrestricted flow between annuluses 80 and 82 when valve member 100 is in its first position. Valve mechanism 140 may define a more restrictive orifice between annuluses 80, 82 when valve member 100 is shifted to the right to its second position.

Valve mechanism 140 may include a cylindrical sleeve 144 having a pair of axially spaced cylindrical lands 146, 148 with land 148 being cylindrically larger than land 146. Sleeve 144 may be slidably disposed on the reduced diameter portion 106 of valve member 100 and may be retained thereon by a retaining ring 150. With valve member 100 and sleeve 144 at the position shown in FIG. 1, annular land 146 may cooperate with land 86 of housing 74 to define the size of orifice 142. Sleeve 144 may be moveable leftwardly relative to valve member 100 to a position at which sleeve land 146 is spaced from housing land 86 to provide substantially unrestricted fluid flow from the annulus 82 to annulus 80 when the valve member is at the first position. When valve member 100 is at the second position, the annular land 148 may cooperate with land 86 to define a more restrictive orifice 142. Alternatively, sleeve 144 can be designed without lands and can be, for example, a conical or other shaped surface to provide a variable orifice 142.

Industrial Applicability

As set forth above, control valve 26 may provide for four (4) distinct fluid circuit operations. These operations may include: (1) a raising blade operation; (2) a holding blade operation; (3) a controlled lowering blade operation; and (4) a floating blade operation. The floating blade operation may include both a substantially free vertical movement of blade 14 and a quick free-fall of blade 14 from a raised position, hereinafter referred to as a quick drop operation. The four (4) fluid circuit operations provided by control valve 26 may be independently actuated by shifting control valve 26 between its four (4) possible positions shown in FIG. 1A. Movement of control valve 26 between the four (4) possible positions may be achieved by regulating fluid pressure from pilot fluid lines 50 via pilot valve 46 based on an angular position of operator controlled lever 52. For example, the position of operator controlled lever 52 shown in FIG. 1A may vent a fluid pressure through pilot fluid lines 50 such that spring 51 biases control valve 26 in it neutral position shown, which corresponds to the holding blade operation. The pilot pressure control of control valve 26 may be achieved in any conventional manner. Alternatively, pilot pressure control of control valve 26 may be replaced with an electrical control or with a mechanical control by way of a mechanical coupling between control valve 26 and operator controlled lever 52.

To initiate the raising blade operation, the operator may move operator controlled lever 52 to a position 152 (shown in dashed lines), which in turn provides the appropriate pilot pressure to shift control valve 26 leftwardly to connect pump 22 to valve conduit 30 and valve conduit 28 to tank 24. The pressurized fluid from pump 22 passes through control valve 26, valve conduit 30, and into annulus 82. Sleeve 144 functions similar to a check valve such that the fluid passing from annulus 82 to annulus 80 moves sleeve 144 leftwardly to provide substantially unrestricted fluid flow therebetween. The pressurized fluid in annulus 80 passes through port 90, cylinder conduit 20, and into lift sides 68 of both hydraulic cylinders 16 causing pistons 70 to retract and thereby raise blade 14. The fluid expelled from drop side 66 passes through cylinder conduit 18, port 88, annulus 78, port 92, valve conduit 28, and control valve 26 to tank 24.

To initiate the controlled lowering blade operation, the operator may move operator controlled lever 52 to a position 154 (shown in dashed lines), which in turn provides the appropriate pilot pressure to shift control valve 26 rightwardly to communicate pump 22 with valve conduit 28 and valve conduit 30 to tank 24. The pressurized fluid from pump 22 passes through control valve 26, valve conduit 28, port 92, annulus 78, port 88, cylinder conduit 18 and into drop sides 66 of hydraulic cylinders 16. The fluid expelled from lift sides 68 passes through cylinder conduit 20, port 90, annulus 80, annulus 82, port 94, valve conduit 30, and control valve 26 to tank 24. The flow forces acting on sleeve 144 bias it to the position shown in FIG. 1 to establish orifice 142. Alternatively, a lightweight coil spring can be used to resiliently bias sleeve 144 to the position shown in FIG. 1A.

With control valve 26 in a position corresponding to the controlled lowering blade operation, control valve 26 restricts the fluid being expelled from lift sides 68 to a flow rate less than a predetermined flow rate. When the fluid flow rate of fluid passing through orifice 142 is less than this predetermined flow rate, the differential pressure generated by orifice 142 is below a predetermined magnitude. Thus, the pressure in annulus 80 and passing through passageway 122 to actuating chamber 124 is insufficient to move valve member 100 rightwardly to its second, quick drop position against the biasing forces keeping valve member 100 in its first position.

The biasing forces acting to keep valve member 100 in its leftmost, first position may include those of spring member 138 and biasing forces resulting from fluid pressure within actuation chamber 132. As will be described further below, even if the fluid flow rate of fluid passing through orifice 142 were greater than the biasing force of spring member 138, valve member 100 would still be unable to shift to its quick drop position because of the pilot pressure being supplied to actuation chamber 132 from pilot pump source 34 via second pilot fluid line 40. The pilot pump fluid supplied to actuation chamber 132 may act to selectively bias valve member 100 in its first position because the right end of actuation chamber is not movable due to piston 126 abutting housing 74 and the left end of actuation chamber 132, which is formed by valve member 100, is movable to expand the actuation chamber 132 and force valve member 100 to its first position. The pressure of pilot pump fluid from pilot source pump 34 may be selected to achieve a pressure in chamber 132 that, when combined with the spring biasing force of spring member 138, is greater than any biasing force that may be created in actuation chamber 124, thus producing a fluid lock within chamber 132.

If blade 14 is positioned against the ground, the operator may want to initiate the floating blade operation. This operation allows blade 14 to freely move vertically as it travels along the ground. This operation is commonly used when the machine attached to blade 14 is moving in reverse. To initiate the floating blade operation, the operator may move operator controlled lever 52 to a position 158 (shown in dashed lines), which in turn provides the appropriate pilot pressure to shift control valve 26 rightwardly to block pump 22 and connect together valve conduit 28, valve conduit 30, and tank 24. Connecting valve conduits 28 and 30 and tank 24 together allow hydraulic fluid to move freely between lift sides 68 and drop sides 66 of hydraulic cylinders 16. This results in the desired free vertical movement of blade 14 as it moves across a varying contour of the ground.

If the floating blade operation is initiated when blade 14 is above the ground, blade 14 will drop toward the ground. This dropping of blade 14 toward the ground will be slightly resisted by a restriction 156 formed within control valve 26 between tank 24 and the junction of valve conduits 28 and 30. Restriction 156, and an inherent delay associated with the flow of fluid between hydraulic cylinders 16 and control valve 26, may result in a relatively slower drop of blade 14 than that provided by the quick drop operation when quick drop valve 10 is actuated. As in the controlled lowering operation, valve member 100 of quick drop valve 10 cannot be shifted to its quick drop position during the floating blade operation because of the pilot pressure being supplied to actuation chamber 132 from pilot pump source 34.

To allow a quick drop of blade 14, the operator may move operator controlled lever 52 to a triggering position 160 (shown in dashed lines), which in turn provides the appropriate pilot pressure to keep control valve 26 in its rightmost position described above. Position 160 may be located in an over travel region of the movement of operator controlled lever 52. The over travel region may include a biasing member, such as a spring, creating a biasing force to urge operator controlled lever 52 out of the over travel region. This biasing force may act to signal to the operator that operator controlled lever 52 is approaching or in position 160 corresponding to a quick drop operation.

In addition to maintaining control valve 26 in its rightmost position, operator controlled lever 52 in triggering position 160 also acts to close switch 65, which in turn actuates solenoid valve 56 to shift leftward to block the flow of pilot pump fluid being supplied to actuation chamber 132 by way of second pilot fluid line 40 and radial passages 134 and 136 of housing 74. Cutting off the supply of pilot pump fluid to actuation chamber 132 acts to unlock quick drop valve 10 to allow it to shift under the pressure resulting from the flow of hydraulic fluid through hydraulic circuit 12, as will be described below. Drainage line 58 and restriction 60 allow for controlled drainage to tank 62 of pilot pump fluid located in second pilot fluid line 40 and actuation chamber 132. This connection to tank 62 allows for the depressurization of actuation chamber 132.

With valve member 100 of quick drop valve 10 unlocked by way of the actuation of solenoid valve 56, fluid being expelled from lift sides 68 of cylinders 16 during a free-fall of blade 14 may provide fluid flow through orifice 142 that exceeds the predetermined flow rate, thereby generating a differential pressure sufficient to move valve member 100 rightwardly to its quick drop position. More specifically, when the differential pressure exceeds the predetermined magnitude, the higher pressure in annulus 80 is directed through passageway 122 into actuating chamber 124. With the differential pressure exceeding the predetermined magnitude, the fluid generated force acting on valve end 102 is greater than the fluid generated force acting on opposite end 104 of valve member 100 by an amount greater than the biasing force of spring 138. Thus, valve member 100 is moved rightwardly toward its quick drop position. As valve member 100 moves rightwardly, annular land 148 creates a more restrictive orifice 142 causing a much greater differential pressure, thereby causing valve member 100 to move more rapidly to the fully actuated quick drop position.

With valve member 100 in its quick drop position, annulus 80 communicates with annulus 78 through pocket 108 thereby allowing the fluid expelled from lift sides 68 to pass therethrough and combine with the fluid passing through port 88 and cylinder conduit 18 to fill drop sides 66 of hydraulic cylinders 16. The more restricted orifice 142 functions also to limit fluid flow therethrough so that a greater amount of fluid expelled from the lift sides is used to fill the expanding drop sides 66 of hydraulic cylinders 16. The amount of fluid passing through orifice 142 is selected to maintain a differential pressure sufficient to keep valve member 100 in the quick drop position. The fluid passing through orifice 142 passes through control valve 26 and back to tank 24.

The operator can shift out of the quick drop operation by moving operator controlled lever 52 out of position 160 and thus causing solenoid valve 56 to shift rightward and communicate pilot pump source 34 to actuation chamber 132. The pressure created in actuation chamber 132, in addition to the biasing force of spring member 138, causes valve member 100 to shift leftward to its first position. This shifting of valve member 100 to its first position will quickly cut off the flow of fluid between annulus 80 and annulus 78 through pocket 108 and result in shifting hydraulic circuit 12 to the floating blade operation detailed above. Alternatively, operator controlled lever 52 may be shifted from position 160 to the position corresponding to the holding blade operation to stop blade 14 from further downward movement. Either act of shifting operator controlled lever 52 out of position 160 will cause a shifting of quick drop valve 100 to its first position and result in a jolting of blade 14 out of its free-fall. This jolting of blade 14 is beneficial in shaking unwanted earth from blade 14.

When blade 14 contacts the ground after a quick drop operation, valve member 100 of quick drop valve 10 immediately shifts back to its first position automatically without any additional effort required by the operator. More specifically, when blade 14 contacts the ground, and extension of hydraulic cylinders 16 stops, fluid is no longer expelled from lift sides 68 of hydraulic cylinders 16. With no fluid passing through orifice 142, the pressure differential reduces thereby allowing spring 138 to move valve member 100 to the first position.

Further ensuring that valve member 100 is in its first position during controlled lowering of blade 14, radial passage 118 allows pressurized fluid from pump 22 to enter actuation chamber 132 to urge valve member to its first position. Spring biased check valve 120 provided in radial passage 118 prohibits pilot pump fluid from second pilot fluid line 40 from escaping actuation chamber 132 via radial passage 118. Alternatively, spring biased check valve 120 may be omitted if an additional piston is located in bore 110 between radial passageway 136 and radial passageway 118 so as to form separate actuation chambers. The additional piston should be configured so not to be capable of completely blocking either of passageways 136 or 118.

In view of the foregoing it is readily apparent that the present invention provides an improved hydraulic quick drop circuit. For example, the present invention allows for the advantages of a quick drop valve that is triggered at a clearly identifiable position of the operator controlled lever. Further, location of the quick drop actuation at an extreme of the range of movement of operator controlled lever 52 provides for a greater modulation range of operator controlled lever 52 resulting in a greater control of the movement of blade 14, especially in a controlled lowering operation.

The present invention utilizes a fluidly controlled quick drop valve and thus avoids the drawbacks of a fully electrically controlled quick drop valve. Such fully electrically controlled quick drop valves require added components to take into account, for example, the need to deactivate the quick drop valve when the blade reaches the ground. Further, fully electrically controlled quick drop systems are less reliable than systems incorporating hydraulic circuits.

Other embodiments of the invention will be apparent to those skilled in the art from consideration of the specification and practice of the invention disclosed herein. For example, pilot circuit 32 of the auxiliary control system could be replaced with an equivalent gas or electric circuit for biasing quick drop valve member 100 in its first position. The auxiliary control system could also be integrated with the hydraulic circuit 12 so that hydraulic fluid of hydraulic circuit 12 acts to bias quick drop valve member 100 in its first position. The auxiliary control system could also be configured so that blocking the flow of fluid, or other medium, to valve member 100 acts to bias valve member 100 in its first position. Finally, solenoid valve 56 and electric switch 65 may be replaced with a fluid or mechanical assembly on electronic control arrangement. It is intended that the specification and examples be considered as exemplary only, with a true scope and spirit of the invention being indicated by the following claims.

What is claimed is:

1. A fluid circuit for raising and lowering an implement, comprising:

a quick drop valve member movable between at least a first position and a second position, the first position corresponding to a non-quick drop hydraulic fluid flow path of the fluid circuit and the second position corresponding to a quick drop hydraulic fluid flow path of the fluid circuit, the quick drop valve member being movable between at least the first and second positions based on valve actuation pressures in the fluid circuit produced by hydraulic fluid; and a control system configured to selectively apply a biasing force against the quick drop valve member biasing the quick drop valve in the first position, the control system providing the biasing force independent of the valve actuation pressures in the fluid circuit produced by the hydraulic fluid.

2. A fluid circuit according to claim 1, wherein the selectively applied biasing force results from fluid pressure against the valve member.

3. A fluid circuit according to claim 2, wherein the fluid pressure against the valve member originates from a source that is separate from a source creating the hydraulic fluid pressure of the fluid circuit.

4. A fluid circuit according to claim 1, wherein the implement is a blade of an earth moving machine.

5. A fluid circuit according to claim 1, further including an operator controlled lever having a range of movement including a triggering position, and movement of the operator controlled lever to the triggering position controls the selectively applied biasing force.

6. A fluid circuit according to claim 5, wherein the triggering position of the operator controlled lever is located at an end of the range of movement of the operator controlled lever.

7. A fluid circuit according to claim 5, further including an electric switch which is closed when the operator controlled lever is moved to the triggering position, the closing of the electric switch activating a solenoid valve to block a supply of pressurized fluid flowing to the quick drop valve member.

8. A fluid circuit for raising and lowering an implement, comprising:

a quick drop valve member movable between at least a first position and a second position, the first position corresponding to a non-guick drop hydraulic fluid flow path of the fluid circuit and the second position corresponding to a guick drop hydraulic fluid flow path of the fluid circuit, the implement being movable based on pressures in the fluid circuit produced by hydraulic fluid;

a control system configured to selectively apply a biasing force against the quick drop valve member biasing the quick drop valve in the first position, the control system providing the biasing force independent of pressures in the fluid circuit produced by the hydraulic fluid for moving the implement; and an operator controlled lever having a range of movement including a triggering position, and movement of the operator controlled lever to the triggering position initiates removal of the selectively applied biasing force against the quick drop valve member.

9. A fluid circuit for raising and lowering an implement, comprising:

a hydraulic fluid pump;

at least one hydraulic cylinder selectively hydraulically coupled to the hydraulic fluid pump, the at least one hydraulic cylinder including a lift side and a drop side and being coupled to a working implement;

at least one control valve located between the hydraulic fluid pump and the at least one hydraulic cylinder;

a quick drop valve fluidly coupled to the at least one hydraulic cylinder, the quick drop valve including a quick drop valve member movable between a first valve member position blocking hydraulic fluid communication between the lift side and drop side of the at least one hydraulic cylinder and a second valve member position allowing hydraulic fluid communication between the lift side and the drop side of the at least one hydraulic cylinder; and a fluid lock selectively fluidly biasing the quick drop valve member in the first position.

10. A fluid circuit according to claim 9, further including an operator controlled lever having a range of movement including a triggering position, and movement of the operator controlled lever to the triggering position initiates disengagement of the fluid lock.

11. A fluid circuit according to claim 10, wherein the triggering position of the operator controlled lever is located at an end of the range of movement of the operator controlled lever.

12. A fluid circuit according to claim 10, further including a electric switch which is closed when the operator controlled lever is moved to the triggering position, the closing of the electric switch activating a solenoid valve to block a supply of pressurized fluid flowing to the quick drop valve member.

13. A fluid circuit according to claim 9, further including a pilot fluid pump fluidly coupled to the fluid lock.

14. A fluid circuit according to claim 9, wherein the control valve includes passages fluidly connecting the lift side of the at least one cylinder to the drop side of the at least one hydraulic cylinder.

15. A fluid circuit according to claim 9, wherein the implement is a blade of an earth moving machine.

16. A fluid circuit for raising and lowering an implement, comprising:

a hydraulic fluid pump;

a plurality of hydraulic cylinders selectively hydraulically coupled to the hydraulic fluid pump, the plurality of hydraulic cylinders each including a lift side and a drop side and being coupled to a working implement;

at least one control valve located between the hydraulic fluid pump and the plurality of hydraulic cylinders, the control valve having four positions, the four positions corresponding to a rising implement operation of the fluid circuit, a controlled lowering of implement operation of the fluid circuit, a holding of implement operation of the fluid circuit and a floating of implement operation of the fluid circuit;

a quick drop valve located between the control valve and the plurality of hydraulic cylinders, the quick drop valve including a quick drop valve member movable by hydraulic fluid within the fluid circuit between a first valve member position blocking hydraulic fluid communication between the lift sides and drop sides of the plurality of hydraulic cylinders and a second valve member position allowing hydraulic fluid communication between the lift sides and the drop sides of the plurality of hydraulic cylinders; and a solenoid valve having a flow-through position allowing pressurized pilot fluid to flow to the quick drop valve to bias the quick drop valve member in the first position, and a blocked position disconnecting the pressurized pilot fluid flow to the quick drop valve member, the solenoid valve being actuated to its blocked position by an electric switch activated by moving an operator controlled lever to a triggering position.

17. A method for controlling movement of an implement, comprising:

positioning an operator controlled lever to at least a first position corresponding to a raising implement operation and the application of a biasing force against a quick drop valve member of a quick drop valve;

positioning the operator controlled lever to at least a second position corresponding to a holding implement operation and the application of the biasing force against the quick drop valve member;

positioning the operator controlled lever to at least a third position corresponding to a controlled lowering implement operation and the application of the biasing force against the quick drop valve member; and positioning the operator controlled lever to at least a fourth position corresponding to a releasing of said biasing force against the quick drop valve member to allow the quick drop valve member to move between a quick drop position and a non-quick drop position.

18. The method for controlling movement of an implement according to claim 17, further including positioning the operator controlled lever to at least a fifth position corresponding to a floating implement operation.

19. The method for controlling movement of an implement according to claim 17, wherein the fourth position of the operator controlled lever is located at an end of a range of movement of the operator controlled lever.

20. The method for controlling movement of an implement of claim 17, wherein the implement is a blade of an earth moving machine.

* * * * *